US006135209A

United States Patent [19]

Uhlenkott

[11] Patent Number: 6,135,209

[45] Date of Patent: Oct. 24, 2000

[54] METHOD FOR INSTALLING A WATER WELL PUMP

[76] Inventor: William Uhlenkott, Rte. 1, Box 20A, Fenn, Id. 83531

[21] Appl. No.: 09/165,261

[22] Filed: Oct. 1, 1998

[51] Int. Cl.[7] ..... E21B 43/00; E21B 17/20

[52] U.S. Cl. ..... 166/369; 166/65.1; 166/242.2; 166/380

[58] Field of Search ..... 166/65.1, 369, 166/380, 384, 385, 242.2

[56] References Cited

U.S. PATENT DOCUMENTS

| | | | |
|---|---|---|---|
| 2,722,237 | 11/1955 | Rosel | 138/56 |
| 2,760,579 | 8/1956 | Kabakoff | 166/75 |
| 2,829,190 | 4/1958 | Comlossy, Jr. | 174/47 |
| 3,095,908 | 7/1963 | Plummer | 138/107 |
| 3,170,520 | 2/1965 | Arutunoff | 166/65 |
| 3,478,667 | 11/1969 | Bourquin | 98/40 |
| 3,814,835 | 6/1974 | Merry | 174/70 R |
| 3,844,345 | 10/1974 | Evans et al. | 166/72 |
| 3,961,647 | 6/1976 | Doubleday | 138/103 |
| 3,992,565 | 11/1976 | Gatfield | 174/15 WF |
| 4,004,326 | 1/1977 | Beavers | 24/81 CC |
| 4,064,355 | 12/1977 | Neroni et al. | 174/47 |
| 4,064,601 | 12/1977 | Miyagishima | 24/16 PB |
| 4,068,966 | 1/1978 | Johnson et al. | 403/397 |
| 4,086,937 | 5/1978 | Hechler, IV | 137/559 |
| 4,262,703 | 4/1981 | Moore et al. | 138/115 |
| 4,337,969 | 7/1982 | Escaron et al. | 285/24 |
| 4,361,937 | 12/1982 | Davis | 24/68 PP |
| 4,368,348 | 1/1983 | Eichelberger et al. | 174/47 |
| 4,470,433 | 9/1984 | Vipond et al. | 138/106 |
| 4,483,395 | 11/1984 | Kramer et al. | 166/241 |
| 4,569,392 | 2/1986 | Peterman | 166/242 |
| 4,570,705 | 2/1986 | Walling | 166/77 |
| 4,850,396 | 7/1989 | McClish et al. | 138/103 |
| 4,869,238 | 9/1989 | Opie et al. | 128/6 |
| 5,201,908 | 4/1993 | Jones | 128/4 |
| 5,386,817 | 2/1995 | Jones | 128/4 |
| 5,678,609 | 10/1997 | Washburn | 138/107 |

*Primary Examiner*—Hoang Dang
*Attorney, Agent, or Firm*—Chernoff, Vilhauer, McClung & Stenzel, LLP

[57] ABSTRACT

A hose and wire combination adapted to provide water and electrical connections to a water well pump includes a hose adapted to bear water, a resilient-material conduit affixed to and extending longitudinally along the exterior of the hose and having a longitudinally extending slot and a set of wires extending longitudinally within the conduit and being electrically insulated from one another. A method of installing a pump comprises the steps of providing a hose and wire combination, removing a terminal portion of the wires from the conduit portion by way of the slot and severing the corresponding terminal portion of the conduit portion. Next, electrically connecting the set of at least four wires to the electrical terminals of the pump. Additionally, operatively connecting the hose to the water discharge spout of the pump. And finally, lowering the pump connected to the hose and wire combination into the well, thereby permitting the resilient material conduit to protect the wires during the lowering and afterwards during the operation of the pump.

2 Claims, 2 Drawing Sheets

METHOD FOR INSTALLING A WATER WELL PUMP

BACKGROUND OF THE INVENTION

Referring to FIG. 1, after drilling a water well 10, an electric pump 12, which is connected to a hose 14 and an electric power cord 16, must be installed in the well for pumping water through the hose 14 to the surface. The power cord typically includes four wires, three for supplying single phase 220-volt power and a fourth to apply a ground for the pump 12. The power cord is typically spot bound to the hose 14 or pipe (with binding locations 18 separated by twenty feet of hose length or less) with tape or clamps as the pump 12, hose 14 and cord 16 are being lowered into the well.

Unfortunately, this method leaves quite a bit to be desired. First, it requires the repeated action of binding the cord 16 to the hose 14, slowing the pump lowering and installation process. Second, the cord 16 is exposed both as it is being lowered and after the installation process is complete and the pump is in operation. It is a common practice in well drilling to sheath the interior of the upper part of the well hole with metal tube 20, to prevent the movement of mud into the well. Further down, where the well hole extends through bedrock 22, the tube 20 is unnecessary. The transition 24 from tube 20 to unsheathed rock can include some rather sharp rock surfaces or the hole may not be plumb. As a result, the power cord 16, which is clad only in standard insulation, may be severed by sharp rocks during pump installation or operation or when pulling the pump during servicing. In either instance the cord must be retrieved and repaired, which is a time consuming operation.

A number of references do address problems associated with operating electrical equipment in oil drilling and in association with vacuum cleaner hoses.

Doubleday, U.S. Pat. No. 3,961,647, discloses a suction pipe for a suction operated cleaner in which the pipe sections are provided with integral extensions thereon forming an axial channel along the outside of the pipe which is open on one side to receive a supply conduit, such as an electric cable. FIGS. 2, 3, and 4 are of particular relevance to the cable retainment. However, the suction pipe taught by Doubleday includes many interlocking pieces which would be susceptible to leakage over time and would not be suitable for an application that should not leak for an extended period of time, such as a well.

Neroni et al., U.S. Pat. No. 4,064,355, disclose a vacuum cleaner hose having a longitudinally attached conduit retaining an electric cord. The cord is not removable from the conduit, other than by pulling it out from one of the ends, and there is no teaching of using such a device for the installation of a pump in a water well.

Peterman, U.S. Pat. No. 4,569,392, discloses a flexible control line for communication in a well bore having a communication tube and a strength member extending along the tube. The tube and strength member are encapsulated in a sheath of elastomeric material. Peterman does not suggest that the communication tube includes an electrical wire for controlling a pump, nor its use for water wells.

Davis, U.S. Pat. No. 4,361,937, discloses a cable banding lock ring that engages around the strap between the cable and discharge pipe for use in a well. Johnson et al., U.S. Pat. No. 4,068,966 another mounting apparatus.

Escaron et al., U.S. Pat. No. 4,337,969, disclose a rigid extension member for use with a well-logging cable in a bore hole which has a structure for protecting the well-logging cable disposed along the length of, and on the outer surface of, a cylindrical tube. The extension member has a fixed length with screw threads on either end. Moreover, the wires are encased in a single insulating medium which does not appear to be easily separable.

Merry, U.S. Pat. No. 3,814,835; Evans et al., U.S. Pat. No. 3,844,345; and Plummer, U.S. Pat. No. 3,095,908 all disclose tubular members with associated control lines.

Opie et al, U.S. Pat. No. 4,869,238; Jones, U.S. Pat. No. 5,201,908; and Jones, U.S. Pat. No. 5,386,817 all show endoscope sheaths. Although these devices show a structure having a number of lumens or channels, the main lumen or channel is designed to allow the passage of an endoscope and the associated fiber optics, rather than the substantial amounts of water yielded by a water well pump. Moreover, electrical wires do not appear to be included. The auxiliary channels shown are for water, air and vacuum.

What is needed, therefore, but not yet available, is an apparatus and method for facilitating the installation of a water well pump into a well hole that obviates the need to repeatedly tie a power cord to the well pipe as the pump is being lowered into the well hole and which protects the power cord during and after the pump installation process.

SUMMARY OF THE INVENTION

The present invention comprises a hose and wire combination adapted to provide water and electrical connections to a water well pump and comprising a hose adapted to bear water and having an exterior, a resilient-material conduit affixed to and extending longitudinally along the exterior of the hose and having a longitudinally extending slot and a set of wires extending longitudinally within the conduit and being electrically insulated from one another.

A separate aspect of the present invention comprises a method of installing a pump, having electrical terminals and a water discharge spout into a water well, comprising the steps (not necessarily performed in the order presented) of first providing a hose and wire combination, including a hose adapted to bear water and having an exterior; a resilient-material conduit affixed to and extending longitudinally along the exterior of the hose and having a longitudinally extending slot; and a set of at least four wires extending longitudinally within the conduit and being electrically insulated from one another. Second, removing a terminal portion of the wires from the conduit portion by way of the slot and severing the corresponding terminal portion of the conduit portion. Third, electrically connecting the set of at least four wires to the electrical terminals of the pump. Fourth, operatively connecting the hose to the water discharge spout of the pump. And fifth, lowering the pump connected to the hose and wire combination into the well, thereby permitting the resilient material conduit to protect the wires during the lowering and afterwards during the operation of the pump and when removing the pump for servicing.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figures 2, 3:
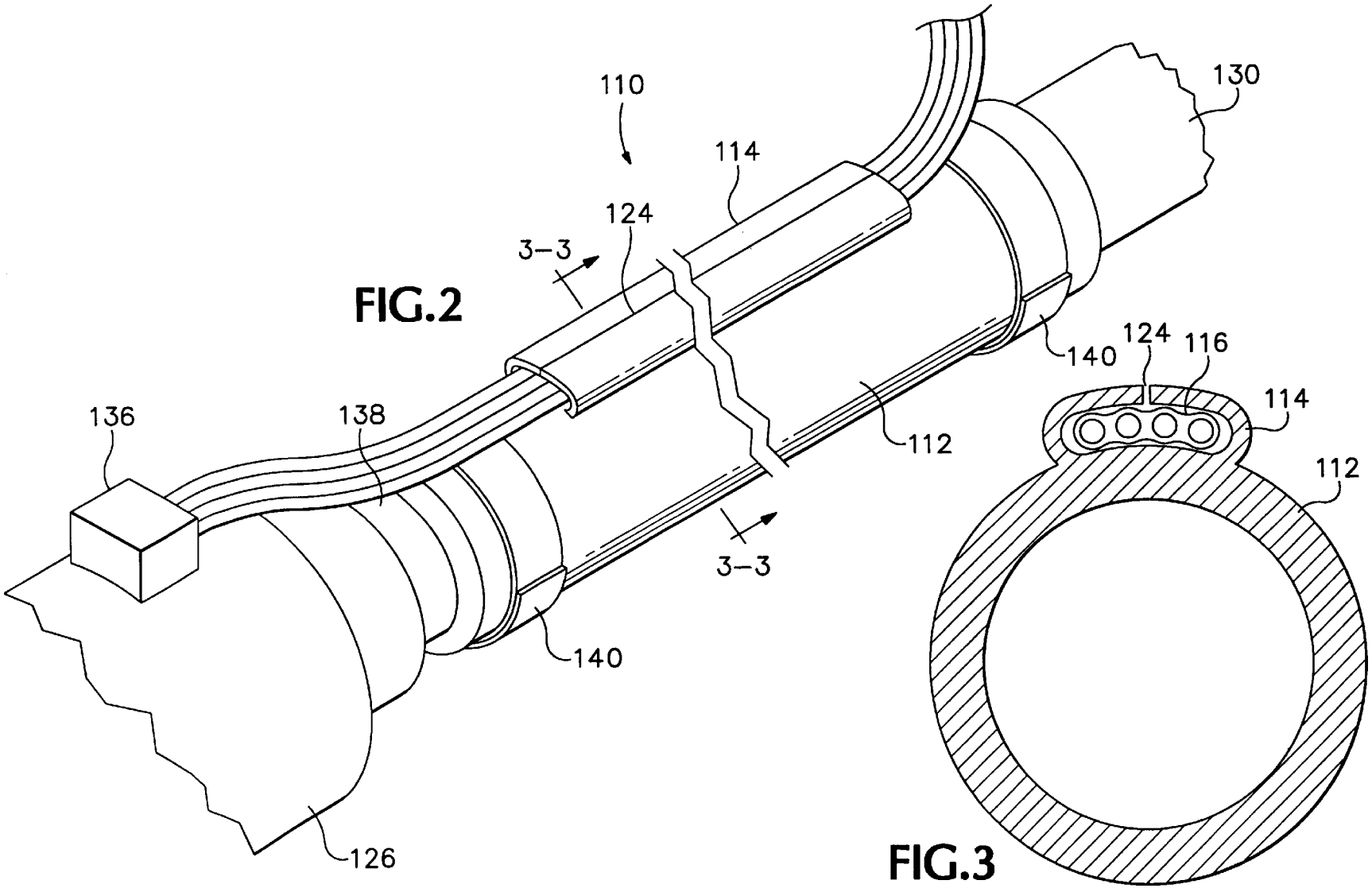
FIG. 2 is an isometric drawing of a hose and wire combination according to the present invention, connected to a water well pump and also connected to a water pipe for delivering water to an end user.
FIG. 3 is a cross-sectional view of the hose and wire combination of FIG. 2, taken along line 3—3 of FIG. 2.

Referring to FIGS. 2 and 3, a preferred embodiment of the present invention is a hose and wire combination 110 preferably made of PVC or other flexible polymer. A hose portion 112 preferably has a one inch inner diameter and a one and three quarter inch outer diameter. It is to be understood that the hose and wire can be any size. A conduit portion 114 extends along the length of the hose portion 112 and accommodates a set of four individually insulated wires 116. A slot 124 extends the length of the conduit portion 114.

The hose and wire combination 110 is to be provided in a long length wrapped about a spool, to well pump installers. The installation would begin by pulling the ends of wires 116 through the slot 124 and snipping away the now empty end of conduit portion 114 so that it does not obstruct the attachment process. It may be necessary to cut back hose portion 112 so that wires 116 extend a sufficient length beyond hose portion 112 to permit connection. Then wires 116 are attached to corresponding set of electrical terminals 136 on pump 126. The output spout 138 of pump 126 is inserted into the end of hose portion 112 and secured in place with two clamps 140. The pump 126 is then lowered into the well as the hose and wire combination 110 is unspooled.

Figure 1:
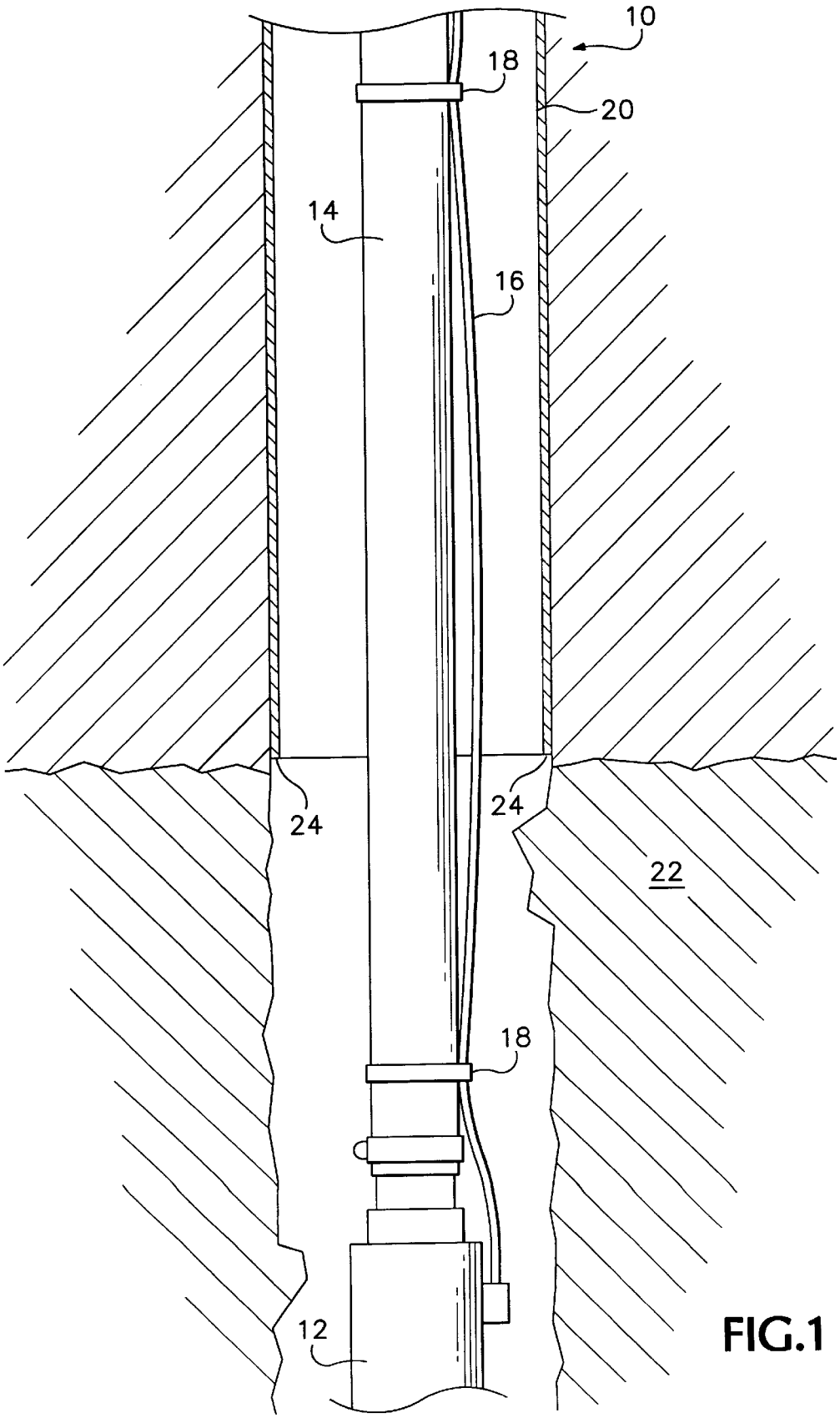
FIG. 1 is a cross-sectional view of a water well according to the prior art.

At least two advantages are evident from this operation. First, the operation of periodically attaching the wires 116 to the hose portion 112 with clamps is unnecessary because wires 116 are held in place by conduit 114. This saves time and labor. Second, the wires 116 are held close to the hose portion 112 and are protected from sharp rocks by the conduit portion 114. During operation the wires 116 continue to be protected from sharp rocks that the combination 110 may vibrate against during the operation of the pump 126. As noted in the BACKGROUND OF THE INVENTION section and referring to FIG. 1, it is a common practice in well drilling to sheath the interior of the upper part of the well hole with the metal sheet 20, to prevent the movement of mud into the well. Further down, where the well hole extends through the bedrock 22, this sheathing is unnecessary. The transition 24 from sheathing to unsheathed rock can include some rather sharp rock surfaces and as the wires clad only in standard insulation are slid past this region they are sometimes severed. In addition, the entire hole may not be plumb resulting in the wires rubbing on the wall of the hole. When this happens the pump must be reinstalled. The extra protection afforded by the conduit portion 114 in the preferred embodiment prevents the severing of the wires 116 in this manner.

At the upper end of the water well, the hose portion 112 may be cut and attached to a fitting or a pipe 130 so that it may be connected to a water use destination. Wires 116 however, may be extended considerably beyond the spot where the hose portion 112 is cut to facilitate connection to an electric power source. Similar to the procedure in connecting the pump 126 to the combination 110, the part of the conduit portion 114 from which the wires 116 have been removed may be snipped away.

Alternatively, the resilient-material conduit may include no slit therein so the wires are enclosed therein. The wires may alternatively be enclosed within the wall of the hose itself. The wires may alternatively be enclosed within the hose itself adjacent to the fluids therein.

Alternatively, the fingers of the conduit portion may be formed in an overlapping fashion to provide a watertight seal.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of installing a pump, having electrical terminals and a water discharge spout, in a water well, comprising the steps of:

(a) providing a hose and wire combination, including;
  (i) a hose adapted to bear water and having an exterior;
  (ii) a resilient-material conduit affixed to and extending longitudinally along said exterior of said hose and having a longitudinally extending slot; and
  (iii) a set of wires extending longitudinally within said conduit and being electrically insulated from one another;

(b) removing a terminal portion of said wires from said conduit portion by way of said slot and severing the corresponding terminal portion of said conduit portion;

(c) electrically connecting said set of at least four wires to said electrical terminals of said pump;

(d) operatively connecting said hose to said water discharge spout of said pump; and (e) lowering said pump connected to said hose and wire combination into said well, thereby permitting said resilient material conduit to protect said wires during said lowering and afterwards during the operation of said pump.

2. The method of claim 1 further including the steps of, after step (d), cutting said combination near the surface of the earth, so that the conduit extends further than the hose portion, attaching said hose portion to a fitting adapted to attach to horizontally directed hose, removing a portion of said wires from said conduit portion by way of said slot, severing excess of said conduit portion and operatively connecting said wires to a power source.

* * * * *